US007030817B2

(12) United States Patent
Asai et al.

(10) Patent No.: US 7,030,817 B2
(45) Date of Patent: Apr. 18, 2006

(54) BROADBAND ANTENNA APPARATUS

(75) Inventors: Hisato Asai, Tokyo (JP); Shinichi Kuroda, Tokyo (JP); Tomoya Yamaura, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/079,245

(22) Filed: Mar. 15, 2005

(65) Prior Publication Data

US 2005/0156793 A1 Jul. 21, 2005

Related U.S. Application Data

(63) Continuation of application No. 10/404,129, filed on Apr. 2, 2003, now Pat. No. 6,897,811.

(30) Foreign Application Priority Data

Apr. 12, 2002 (JP) ..... 2002-109946
Mar. 7, 2003 (JP) ..... 2003-062287

(51) Int. Cl.
*H01Q 1/38* (2006.01)

(52) U.S. Cl. ..... 343/700 MS; 343/846
(58) Field of Classification Search ..... 343/700 MS, 343/702, 846, 848
See application file for complete search history.

(56) References Cited

U.S. PATENT DOCUMENTS 6,545,640 B1 4/2003 Herve et al. ..... 343/700 MS
2001/0050643 A1 12/2001 Egorov et al. ..... 343/702
2002/0180650 A1 12/2002 Pankinaho et al. ..... 343/702

FOREIGN PATENT DOCUMENTS

JP 2000-216621 8/2000

OTHER PUBLICATIONS

Low-profile, Top-loaded Disk Monopole Antenna, Toshio Segawa et al, The Institute of Electronics, Information and Communication Engineers; Mar. 15, 1993, 4 pages.
U.S. Appl. No. 11/079,245, filed Mar. 15, 2005, Asai, et al.
U.S. Appl. No. 11/079,244, filed Mar. 15, 2005, Asai, et al.
U.S. Appl. No. 11/079,243, filed Mar. 15, 2005, Asai, et al.
U.S. Appl. No. 11/079,221, filed Mar. 15, 2005, Asai, et al.

*Primary Examiner*—Hoang V. Nguyen
(74) *Attorney, Agent, or Firm*—Oblon, Spivak, McClelland, Maier & Neustadt, P.C.

(57) ABSTRACT

A broadband antenna apparatus includes a conducting ground plate, on which a three-dimensional member rests. A radiating conductor is stuck or printed on the three-dimensional member in such a manner that at least part of the radiating conductor is opposite to at least part of the ground plate. A wavelength shortening effect is achieved by the interposition of the three-dimensional member between the opposite parts of ground plate 1 and radiating conductor. This effect makes the broadband antenna apparatus smaller and lower in structure.

1 Claim, 9 Drawing Sheets

BROADBAND ANTENNA APPARATUS

CROSS REFERRNCE TO RELATED APPLICATION

This application is a continuation of application Ser. No. 10,404,129, filed Apr. 2, 2003, now U.S. Pat. No. 6,897,811, the entire contents of which is incorporated herein by reference.

BACKGROUND OF THE INVENTION

1. Field of the Invention

The present invention relates to broadband antenna apparatus for communication systems that need small UWB (ultra wide band) antenna apparatus. The communication systems may be broadband PAN (personal area network) systems using the UWB technology.

2. Description of Related Art

The implementation of a broadband PAN using the UWB technology needs a UWB antenna, which may be a disk monopole antenna.

A very general monopole antenna includes a flat conductor as a ground and a linear conductor as a radiating element. The size of the ground is roughly equal to the working wavelength. The size of the radiating element is about ¼ of the wavelength. The radiating element is set over the ground perpendicularly to it. An arbitrarily gap is formed between the ground and the radiating element, and electricity is supplied in the gap. This monopole antenna can operate in a frequency band lower than 20% of the central frequency. Accordingly, this antenna is unsuitable as it is for a UWB.

It is therefore proposed that the radiating conductor of a monopole antenna be a disk, which has very wide band characteristics. FIGS. 10A and 10B show a disk monopole antenna, which includes a radiating element in the form of a disk.

FIGS. 10A and 10B are a side view and a top plan respectively of a disk monopole antenna. This monopole antenna includes a conducting ground plate 100 and a radiating conductor 200 in the form of a disk. The radiating conductor 200 is set over the ground plate 100 substantially at right angles to it with a gap d between the plate 100 and the conductor 200. As shown in FIG. 10A, the disk monopole antenna has a ground feeding point 100*f* and a signal feeding point 200*f*.

The lowest frequency of the frequency band in which the monopole antenna shown in FIGS. 10A and 10B can operate is the frequency equivalent to a wavelength that is about four times the diameter of the antenna. The highest frequency of this band is several times as high as the lowest frequency. FIG. 12 shows the VSWR (voltage standing wave ratio) characteristic of the monopole antenna shown in FIGS. 10A and 110B, with the radiating conductor 200 having a diameter h of 23.5 mm.

As shown in FIG. 12, the VSWR characteristic is stable over a wide band from about 3 GHz to 8 or more GHz. FIG. 12 confirms that the disk monopole antenna can be used in the wide band. The radiation directivity of the disk monopole antenna shown in FIGS. 10A and 10B is horizontally in-plane non-directional like ordinary monopole antennas.

FIGS. 11A and 11B are side views on the x-z and y-z planes respectively of a bent disk monopole antenna, and FIG. 11C is a top plan of this antenna, which is a modification lowered in height of the disk monopole antenna shown in FIGS. 10A and 10B.

The bent disk monopole antenna shown in FIGS. 11A–11C includes a conducting ground plate 100 and a radiating conductor 200 in the form of a disk. The radiating conductor 200 is set over the ground plate 100 substantially at right angles to it with a gap d between the plate 100 and the conductor 200. The upper half of the radiating conductor 200 is bent so that the height of this conductor is one half of that of the conductor 200 shown in FIGS. 10A and 10B. As shown in FIGS. 11A and 11B, the bent disk monopole antenna has a ground feeding point 100*f* and a signal feeding point 200*f*.

As shown in FIG. 13, the VSWR characteristic of the bent disk monopole antenna shown in FIGS. 11A–11C is such that the lower limit of the frequency band in which the VSWR is 2 or lower is a little higher, but this band is still wider than the frequency band for ordinary monopole antennas. Accordingly, this antenna can be used as a low broadband antenna.

The disk monopole antenna and the bent disk monopole antenna are broadband antenna apparatus that may be used for the broadband PAN system employing the UWB technology. These antennas may still be too large in size to be mounted in or on equipment.

For this reason, it is desired to provide smaller broadband antenna apparatus that can operate in a frequency band not narrower than those for the conventional disk monopole antenna and the conventional bent disk monopole antenna.

SUMMARY OF THE INVENTION

In consideration of the foregoing, it is the object of the present invention to provide a broadband antenna apparatus that includes a radiating conductor in the form of a flat plate, and that is smaller and low enough to be incorporated in equipment.

According to a first aspect of the present invention, a broadband antenna apparatus includes a conducting ground plate and a radiating conductor, which are connected together by a feeder line for transmitting electric power. At least part of the radiating conductor is opposite to at least part of the conducting ground plate.

In the first aspect, the broadband antenna apparatus also includes a three-dimensional member resting on the conducting ground plate. The radiating conductor is stuck or printed on the three-dimensional member.

The interposition of the three-dimensional member between the conducting ground plate and the radiating conductor produces a wavelength shortening effect, which makes the broadband antenna apparatus smaller and lower in structure. Since the radiating conductor can be stuck or printed on the three-dimensional member, the broadband antenna apparatus can be made easily at low cost.

According to a second aspect of the present invention, the three-dimensional member may be a polyhedron; and the radiating conductor may be provided on at least two adjacent sides of the polyhedron.

In the second aspect, the radiating conductor is stuck or printed on at least two adjacent sides of the polyhedron. This makes the broadband antenna apparatus bent in structure. The bent antenna apparatus can be smaller and lower in structure by virtue of a wavelength shortening effect.

According to a third aspect of the present invention, the polyhedron may be a rectangular parallelepiped; and the radiating conductor may be provided on three adjacent sides of the rectangular parallelepiped.

In the third aspect, the radiating conductor can be provided efficiently on the three-dimensional member. This makes the broadband antenna apparatus smaller.

According to a fourth aspect of the present invention, the radiating conductor may include two or more semicircular or sector patterns, which are formed on the three-dimensional member; and the patterns are stuck or printed on the three-dimensional member.

In the fourth aspect, the radiating conductor takes the form of a circle or part of a circle as a whole. It is known that a radiating conductor in the form of a disk is broadband. Accordingly, if the radiating conductor stuck or printed on the three-dimensional member is a circle or part of a circle, the conductor can reliably operate in a broad band.

According to a fifth aspect of the present invention, the radiating conductor may consist of two or more parts, which are connected together by one or more resistors. This suppresses the reflection on the feeding point at low frequencies, and enables the broadband antenna apparatus to maintain good matching so that the apparatus can operate in a wider frequency band.

In the fifth aspect, the broadband antenna apparatus can be smaller for the same frequency.

Other and further objects, features and advantages of the invention will appear more fully from the following description.

DETAILED DESCRIPTION OF THE PREFERRED EMBODIMENTS

Broadband antenna apparatuses embodying the present invention will be described below with reference to the drawings.

As known with respect to so-called patch antennas (thin antennas) etc., a wavelength shortening effect is achieved if a material with a dielectric constant is filled between a radiating conductor or element and a conducting ground plate that are opposed to each other. This effect can reduce the size of the radiating conductor and the distance between this conductor and the ground plate.

The broadband antenna apparatuses described below are miniaturized and lowered by the wavelength shortening effect so as to be built easily in even small devices, and can operate in an ultra wide band.

First Embodiment

Figure 1:
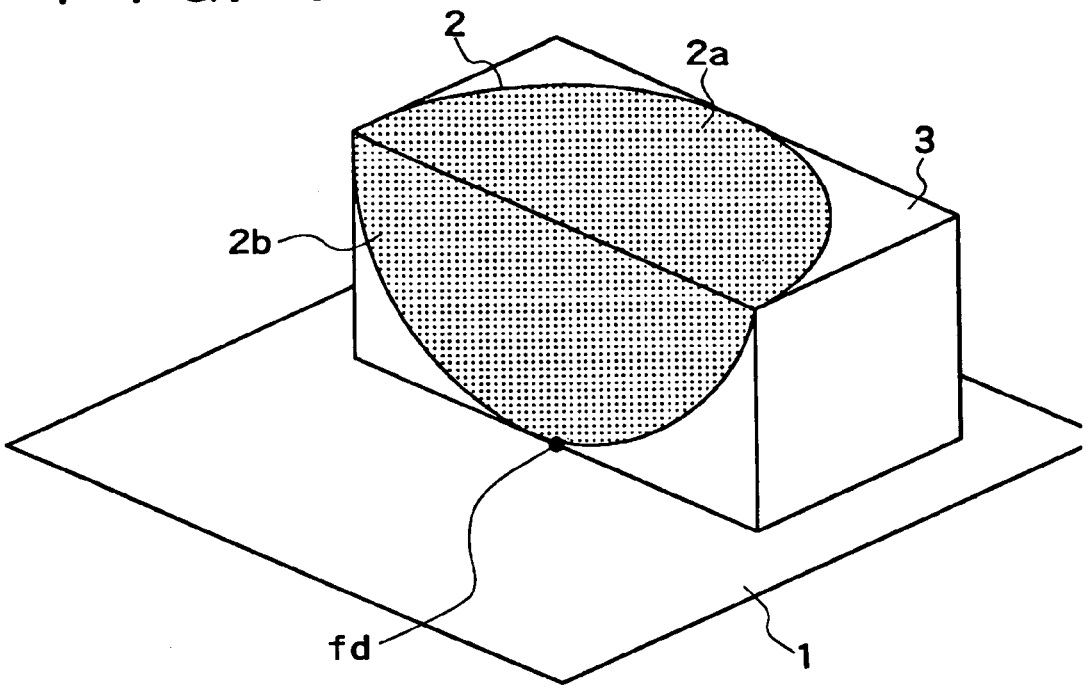
FIG. 1 is a perspective view of a broadband antenna apparatus according to a first embodiment of the present invention.

FIG. 1 shows a broadband antenna apparatus according to a first embodiment of the present invention. The antenna apparatus consists substantially of a conducting ground plate 1, a radiating conductor 2, and a three-dimensional member 3.

The conducting ground plate 1 may be square. The radiating conductor 2 would take the form of a disk if it were not bent as shown in FIG. 1. The three-dimensional member 3 is a rectangular parallelepiped having two square sides of a size and four rectangular sides of a size.

The three-dimensional member 3 rests on the conducting ground plate 1 in such a manner that one of its rectangular sides is in contact with this plate 1.

The radiating conductor 2 consists of two semicircular patterns 2*a* and 2*b*. The semicircular pattern 2*a* is formed on the rectangular side of the three-dimensional member 3 that is parallel to and out of contact with the conducting ground plate 1. The other semicircular pattern 2*b* is formed on one of the rectangular sides of the three-dimensional member 3 that are perpendicular to the ground plate 1.

The radiating conductor 2 may be stuck or applied to the three-dimensional device 3 by means of coating, vapor deposition, adhesion, or plating. Alternatively, the radiating conductor 2 may be printed on the three-dimensional device 3.

This broadband antenna apparatus has a signal feeding point fd substantially on the same plane as the conducting ground plate 1. The feeding point fd is insulated from the ground plate 1. The antenna apparatus functions with electric power supplied to the feeding point fd.

Figure 11A:
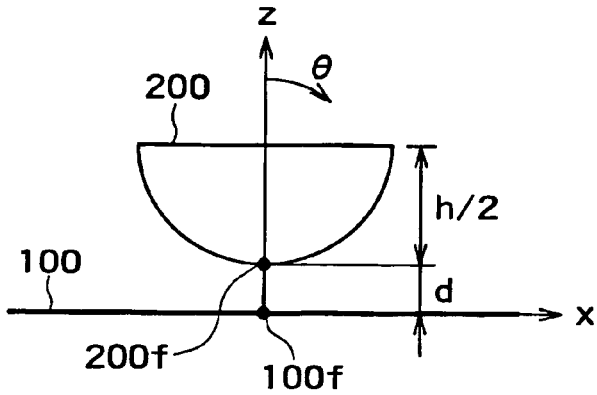
FIG. 11A (PRIOR ART)
FIG. 11A is a side view on the x-z plane of a bent disk monopole antenna, which is an example of the conventional UWB antenna apparatus.
Figure 11B:
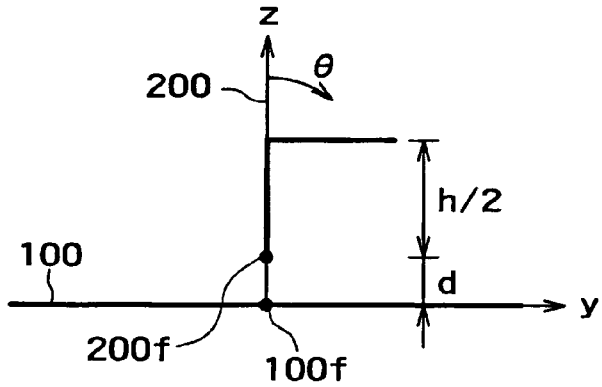
FIG. 11B (PRIOR ART)
FIG. 11B is a side view on the y-z plane of the antenna shown in FIG. 11A.
Figure 11C:
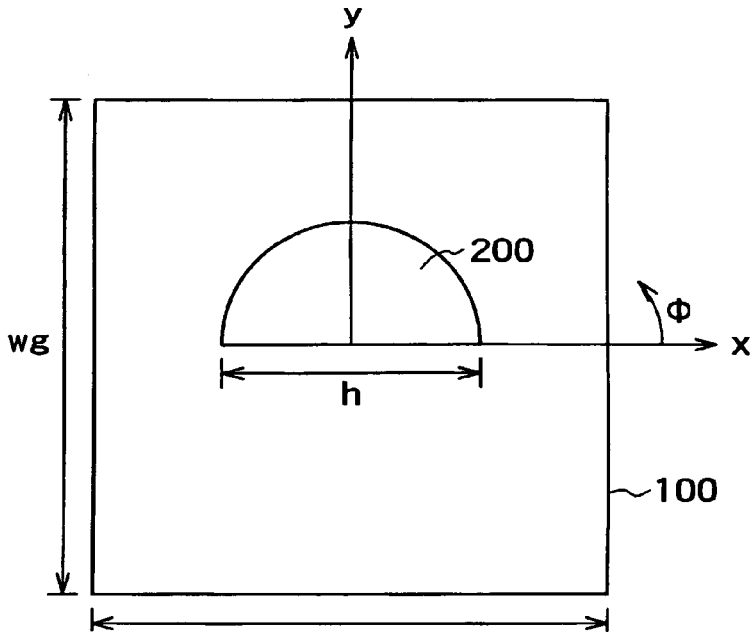
FIG. 11C (PRIOR ART)
FIG. 11C is a top plan of the antenna shown in FIGS. 11A and 11B.
Figure 12:
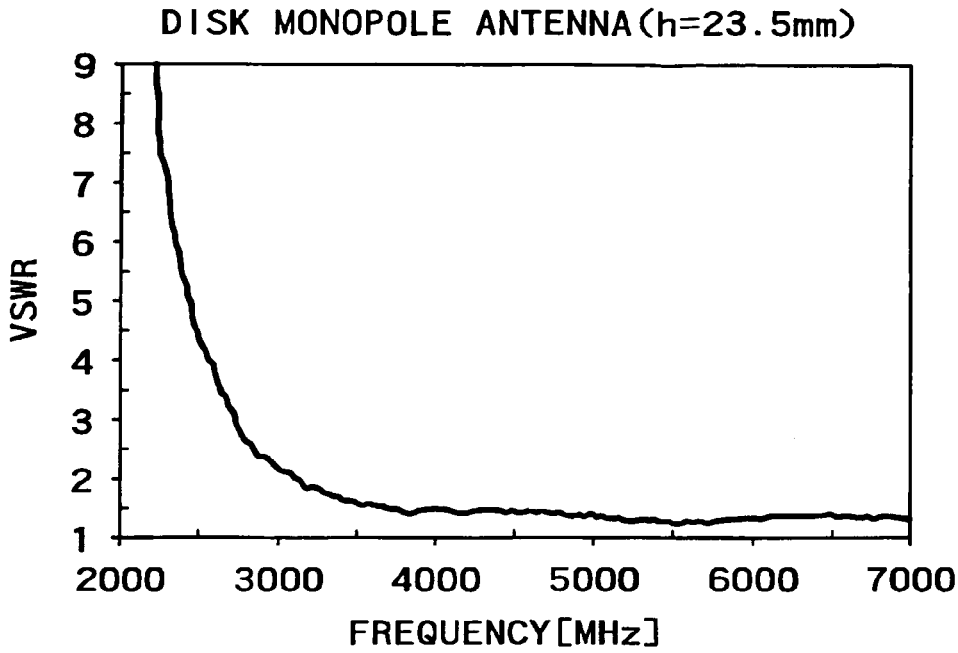
FIG. 12 PRIOR ART
FIG. 12 is a chart of simulation results of the VSWR characteristic of the disk monopole antenna shown in FIGS. 10A and 10B.
Figure 13:
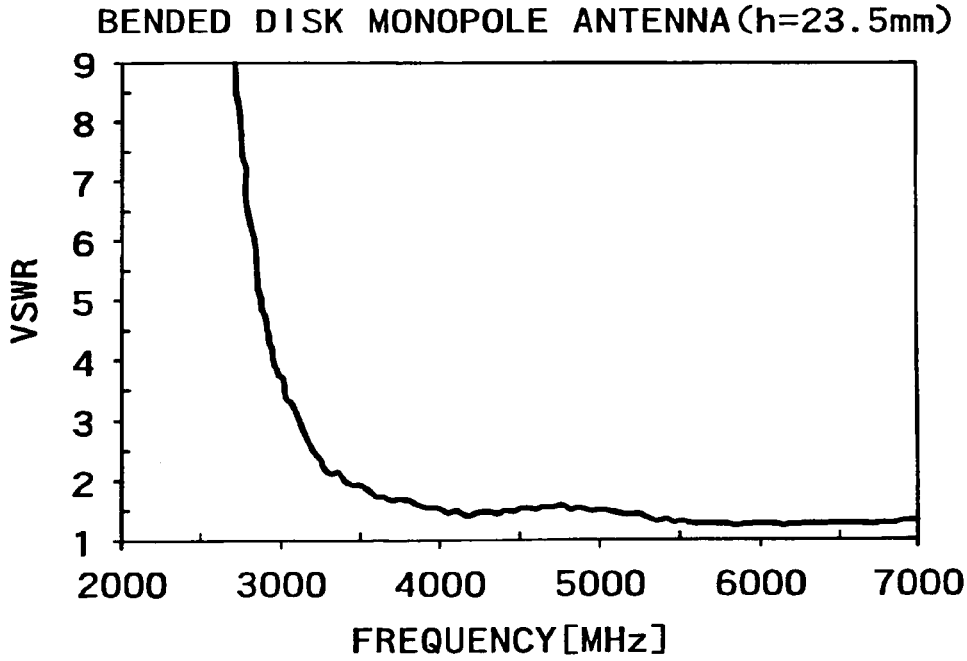
FIG. 13 PRIOR ART
FIG. 13 is a chart of simulation results of the VSWR characteristic of the bent disk monopole antenna shown in FIGS. 11A–11C.

The radiating conductor 2 in the form of a disk enables the antenna apparatus to operate in an ultra wide band similarly to the bent disk monopole antenna shown in FIGS. 11A–11C.

The wavelength shortening effect mentioned above enables the radiating conductor 2 to be smaller in size than a radiating conductor formed without a three-dimensional device 3 interposed. This can make the broadband antenna apparatus even smaller and lower. In other words, this antenna apparatus can operate in an ultra wide band, and is smaller and lower in structure than the conventional bent disk monopole antenna.

Since the radiating conductor 2 can be stuck or printed on two sides of the three-dimensional device 3, it is easy to form this bent conductor 2. This makes it possible to produce the broadband antenna apparatus easily at low cost.

Second Embodiment

Figure 2:
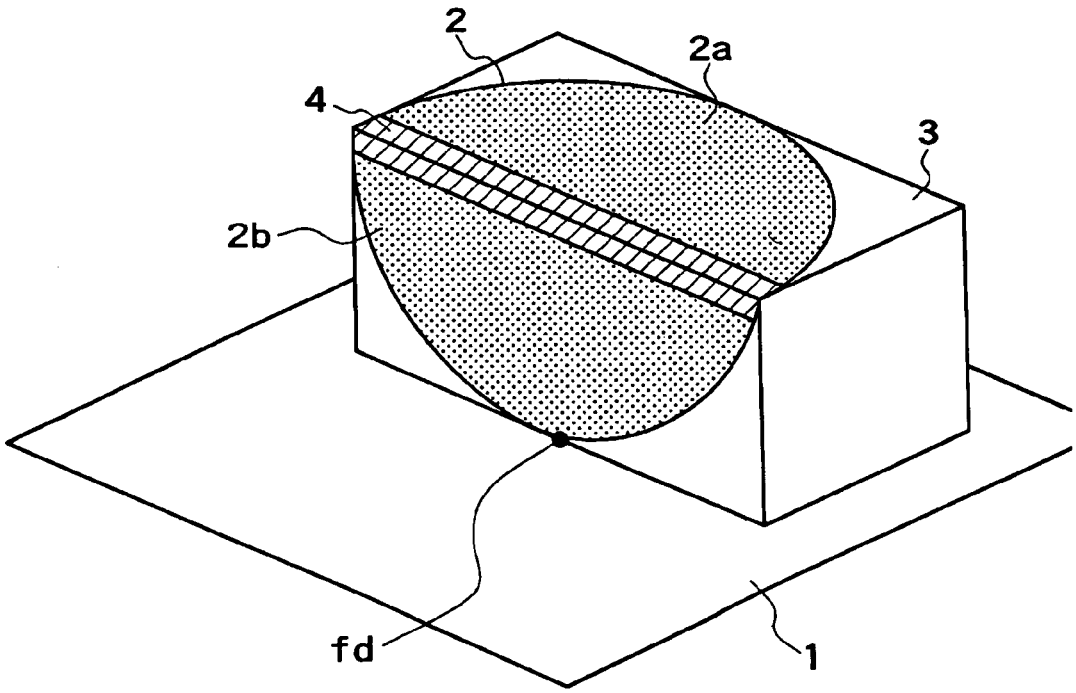
FIG. 2 is a perspective view of a broadband antenna apparatus according to a second embodiment of the present invention.

FIG. 2 shows a broadband antenna apparatus according to a second embodiment of the present invention. This apparatus is substantially identical in structure with the apparatus according to the first embodiment, except that the apparatus shown in FIG. 2 includes a resistance material 4. For this reason, the same reference numerals are assigned to similar parts of the apparatuses according to the two embodiments.

The broadband antenna apparatus shown in FIG. 2 includes a square conducting ground plate 1, a radiating conductor 2, and a three-dimensional member 3 in the form of a rectangular parallelepiped. The radiating conductor 2 would take the form of a disk if it were not bent. The three-dimensional member 3 rests on the ground plate 1 in such a manner that one of its rectangular sides is in contact with this plate 1.

The radiating conductor 2 includes two semicircular patterns 2*a* and 2*b*. The semicircular pattern 2*a* is formed on the rectangular side of the three-dimensional member 3 that is parallel to and out of contact with the conducting ground plate 1. The semicircular pattern 2*b* is formed on one of the rectangular sides of the three-dimensional member 3 that are perpendicular to the ground plate 1. The radiating conductor 2 also includes a resistance material 4, which is interposed between the semicircular patterns 2*a* and 2*b* of the conductor 2 and connects them together. The resistance material 4 crosses the radiating conductor 2 in parallel with the conducting ground plate 1.

The resistance material 4 suppresses the refection on the feeding point at low frequencies, and enables the broadband antenna apparatus to maintain good matching so that the apparatus can operate in a wider frequency band. Even if this apparatus is smaller and lower in structure than the apparatus shown in FIG. 1, they can operate in substantially the same frequency band.

OTHER EXAMPLES OF THE SECOND EMBODIENT

Figure 3A:
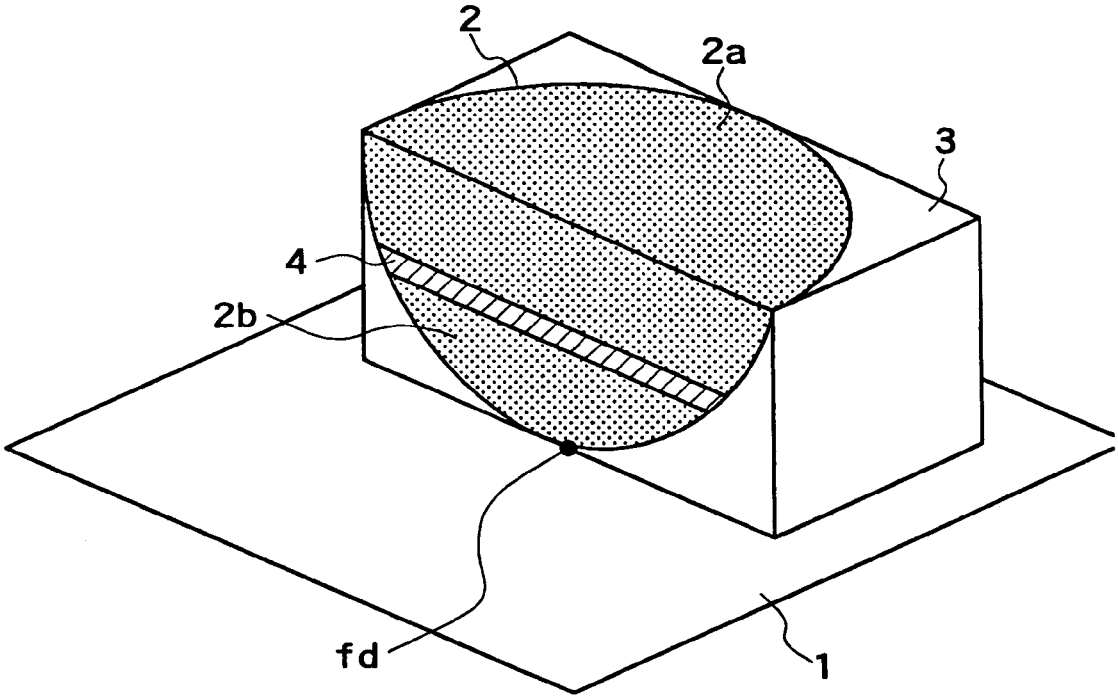
FIGS. 3A and 3B are perspective views of other broadband antenna apparatuses according to the second embodiment.
Figure 3B:
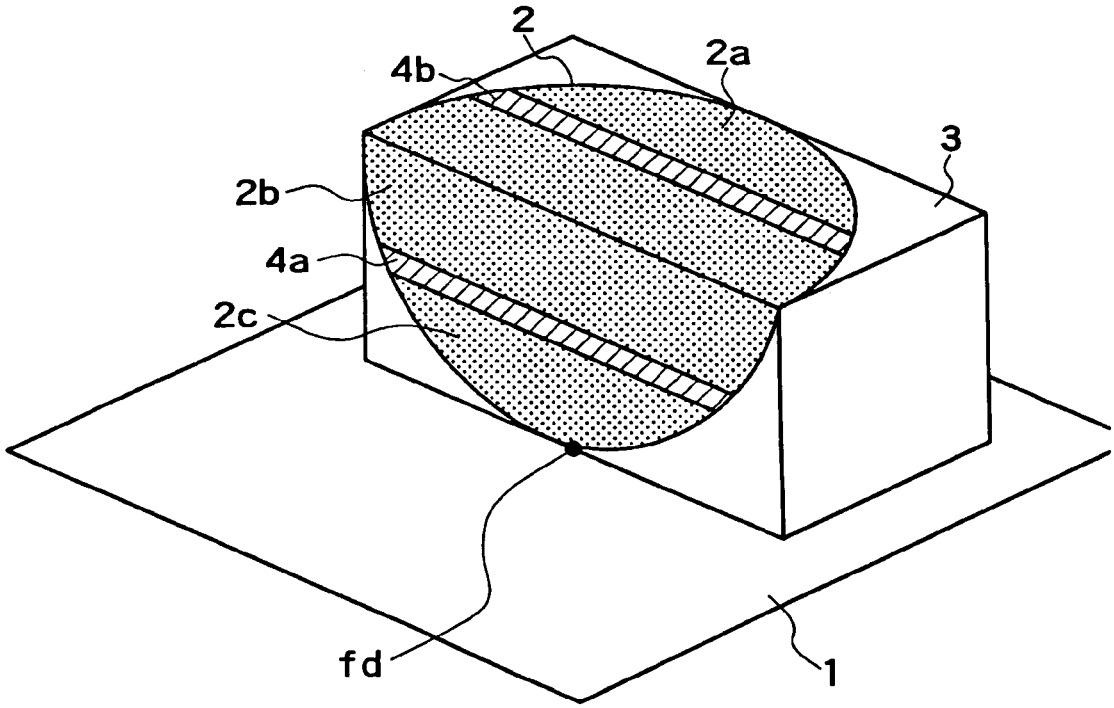

FIGS. 3A and 3B show other broadband antenna apparatuses according to the second embodiment. In FIG. 2, the resistance material 4 is interposed between the semicircular patterns 2*a* and 2*b* of the radiating conductor 2.

The broadband antenna apparatus shown in FIG. 3A includes a conducting ground plate 1 and a radiating conductor 2, which includes two semicircular patterns 2*a* and 2*b*. The semicircular pattern 2*a* is parallel to the ground plate 1. The semicircular pattern 2*b* is perpendicular to the ground plate 1. A resistance material 4 extends across this pattern 2*b*, but might alternatively extend across the other pattern 2*a*. The resistance material 4 might extend at a suitable position across the radiating conductor 2 in parallel to the ground plate 1.

The broadband antenna apparatus shown in FIG. 3B includes a radiating conductor 2, which includes three semicircular patterns 2*a*, 2*b* and 2*c*, and two resistance materials 4*a* and 4*b*. The semicircular pattern 2*b* is interposed between the other patterns 2*a* and 2*c*. The resistance material 4*a* is interposed between the semicircular patterns 2*a* and 2*b*. The resistance material 4*b* is interposed between the semicircular patterns 2*b* and 2*c*. The two resistance materials 4*a* and 4*b* might extend anywhere across the radiating conductor 2.

In this way, the radiating conductor 2 is divided at arbitrary positions into parts, which are connected by resistance materials. This enables the broadband antenna apparatus to operate in a wider frequency band, and to be smaller and lower in structure.

Third Embodiment

Figure 4:
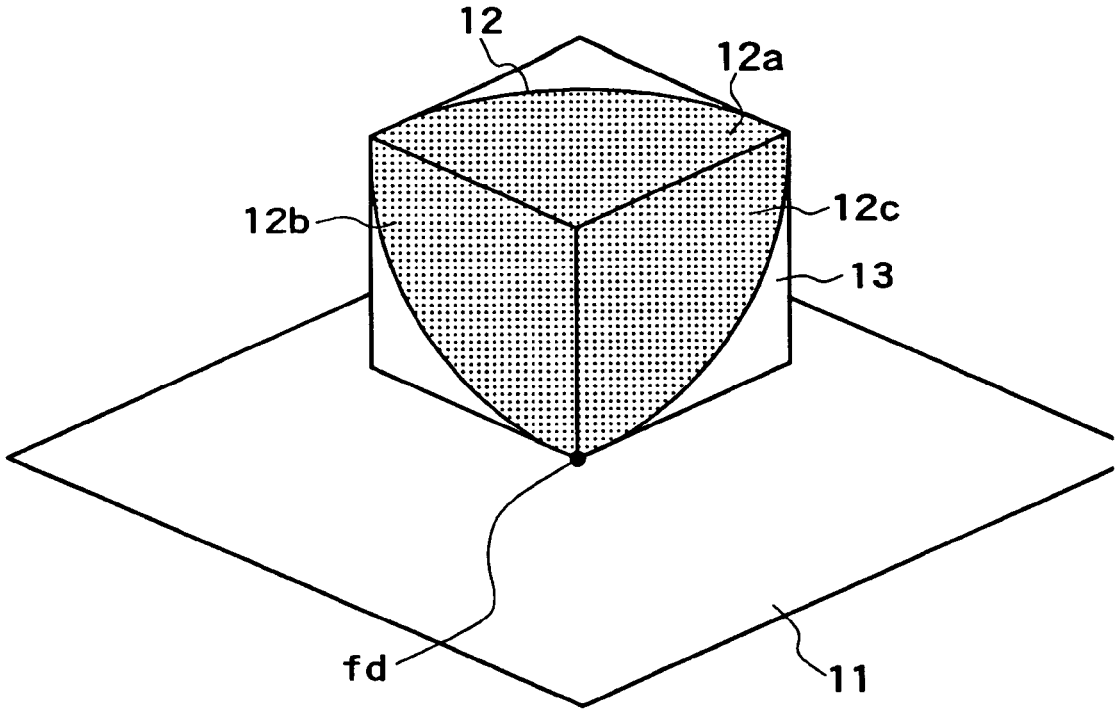
FIG. 4 is a perspective view of a broadband antenna apparatus according to a third embodiment of the present invention.

FIG. 4 shows a broadband antenna apparatus according to a third embodiment of the present invention. The antenna apparatus consists substantially of a conducting ground plate 11, a radiating conductor 12, and a three-dimensional member 13.

The conducting ground plate 11 may be square. The radiating conductor 12 consists of three sector patterns 12*a*, 12*b* and 12*c*. The three-dimensional member 13 is a cube, which has six square sides of a size.

The three-dimensional member 13 rests on the conducting ground plate 11 in such a manner that one of its square sides is in contact with this plate 11. The sector pattern 12*a* is formed on the square side of the three-dimensional member 13 that is parallel to and out of contact with the conducting ground plate 11.

Each of the other sector patterns 12*b* and 12*c* is formed on one of two adjoining square sides of the three-dimensional member 13 that are perpendicular to the ground plate 11. The radiating conductor 12 may be stuck or applied to the three-dimensional member 13, or printed on it, in the same way as the first and second embodiments.

This broadband antenna apparatus has a signal feeding point fd substantially on the same plane as the conducting ground plate 11. The feeding point fd is insulated from the ground plate 11. The antenna apparatus functions with electric power supplied to the feeding point fd.

The radiating conductor 12 is ¾ in area of a disk that is identical in radius with this conductor. This enables the broadband antenna apparatus to operate in a wide frequency band.

The radiating conductor 12 can be formed efficiently on three adjacent sides of the three-dimensional member 13. Moreover, the wavelength shortening effect makes the broadband antenna equipment smaller and lower in structure.

Since the radiating conductor 12 can be stuck or printed on three sides of the three-dimensional member 13, as stated above, it is easy to form this bent conductor. This makes it possible to produce the broadband antenna apparatus easily at low cost.

Fourth Embodiment

Figure 5:
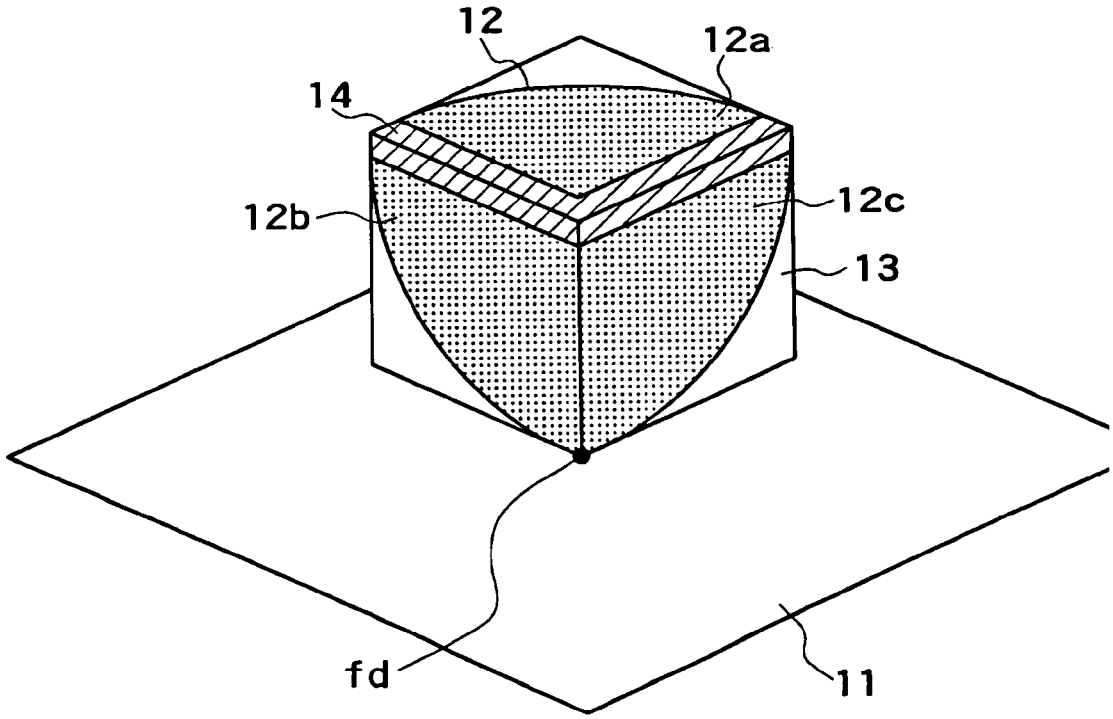
FIG. 5 is a perspective view of a broadband antenna apparatus according to a fourth embodiment of the present invention.

FIG. 5 shows a broadband antenna apparatus according to a fourth embodiment of the present invention. This apparatus is substantially identical in structure with the apparatus according to the third embodiment, except that the apparatus shown in FIG. 5 includes a resistance material 14. For this reason, the same reference numerals are assigned to similar parts of the apparatuses according to these two embodiments.

The broadband antenna apparatus shown in FIG. 5 includes a square conducting ground plate 11, a radiating conductor 12, and a three-dimensional member 13, which is a cube. The radiating conductor 12 includes three sector patterns 12*a*, 12*b* and 12*c*. The three-dimensional member 13 rests on the conducting ground plate 11 in such a manner that one of its square sides is in contact with this plate 11. The sector pattern 12*a* is formed on the square side of the three-dimensional member 13 that is parallel to and out of contact with the conducting ground plate 11. Each of the other sector patterns 12*b* and 12*c* is formed on one of two adjoining square sides of this member 13 that are perpendicular to the ground plate 11.

The resistance material 14 is interposed between the sector patterns 12*a* and 12*b* of the radiating conductor 12, and between the sector patterns 12*a* and 12*c* of the conductor 12. The resistance material 14 connects the sector patterns 12*a* and 12*b* together and the sector patterns 12*a* and 12*c* together. The resistance material 14 crosses the radiating conductor 12 in parallel to the conducting ground plate 11.

The resistance material 14 suppresses the refection on the feeding point at low frequencies, and enables the broadband antenna apparatus to maintain good matching so that the apparatus can operate in a wider frequency band. Even if this apparatus is smaller and lower in structure than the apparatus shown in FIG. 4, they can operate in substantially the same frequency band.

Other Examples of Fourth Embodiment

Figure 6A:
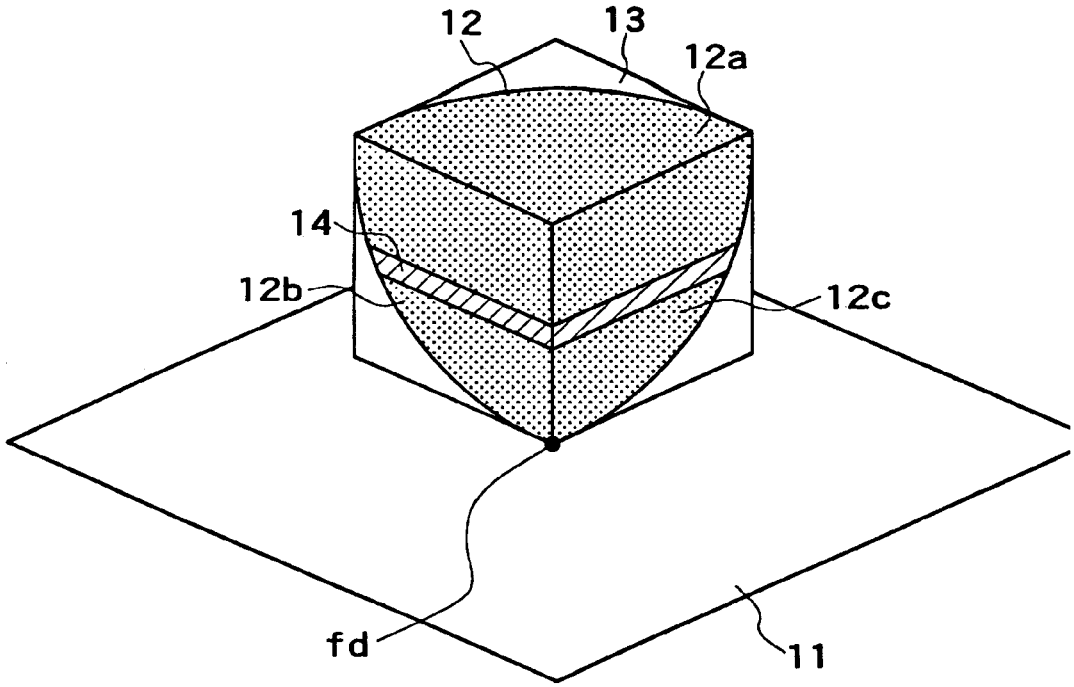
FIGS. 6A and 6B are perspective views of other broadband antenna apparatuses according to the fourth embodiment.
Figure 6B:
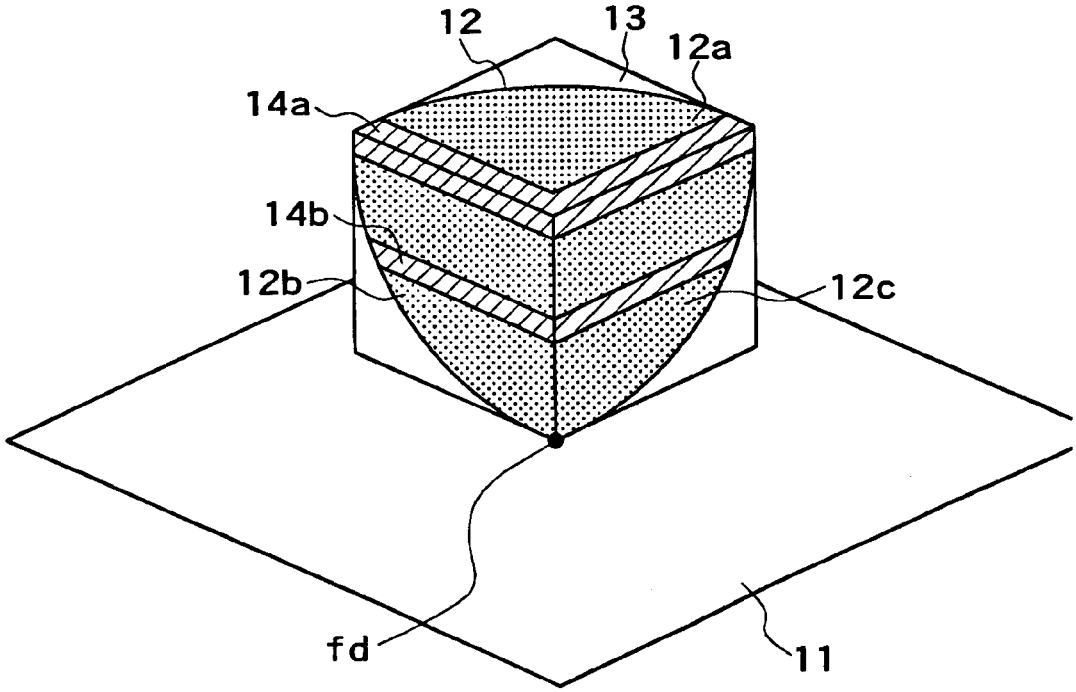

FIGS. 6A and 6B show other broadband antenna apparatuses according to the fourth embodiment. In FIG. 5, the resistance material 4 is interposed between the sector patterns 12*a* and 12*b* of the radiating conductor 12, and between the sector patterns 12*a* and 12*c* of the conductor 12. The resistance material 14 extends in parallel with the conducting ground plate 11.

The broadband antenna apparatus shown in FIG. 6A includes a conducting ground plate 11 and a radiating conductor 12, which includes three sector patterns 12*a*, 12*b*, and 12*c*. The sector pattern 12*a* is parallel to the ground plate 1. The sector patterns 12*b* and 12*c* are perpendicular to the ground plate 11. A resistance material 14 extends across the perpendicular sector patterns 12*b* and 12*c*. The resistance material 14 might extend at a suitable position across the radiating conductor 12 in parallel to the ground plate 11.

The broadband antenna apparatus shown in FIG. 6B includes a conducting ground plate 11 and a radiating conductor 12, which includes three sector patterns 12*a*, 12*b*, and 12*c*. The sector pattern 12*a* is parallel to the ground plate 1. The sector patterns 12*b* and 12*c* are perpendicular to the ground plate 11. A resistance material 14*a* is interposed between the sector patterns 12*a* and 12*b*, and between the sector patterns 12*a* and 12*c*. Another resistance material 14*b* extends across the perpendicular sector patterns 12*b* and 12*c*. The resistance materials 14*a* and 14*b* might extend anywhere across the radiating conductor 12.

In the broadband antenna apparatuses according to the second and fourth embodiments, there is no clearance between each resistance material and the adjoining conductor patterns. However, there might be a suitable clearance between each resistance material and the adjoining conductor patterns. Alternatively, some points of the conductor patterns might be connected by resistance materials and/or resistance elements.

Fifth Embodiment

Figure 7:
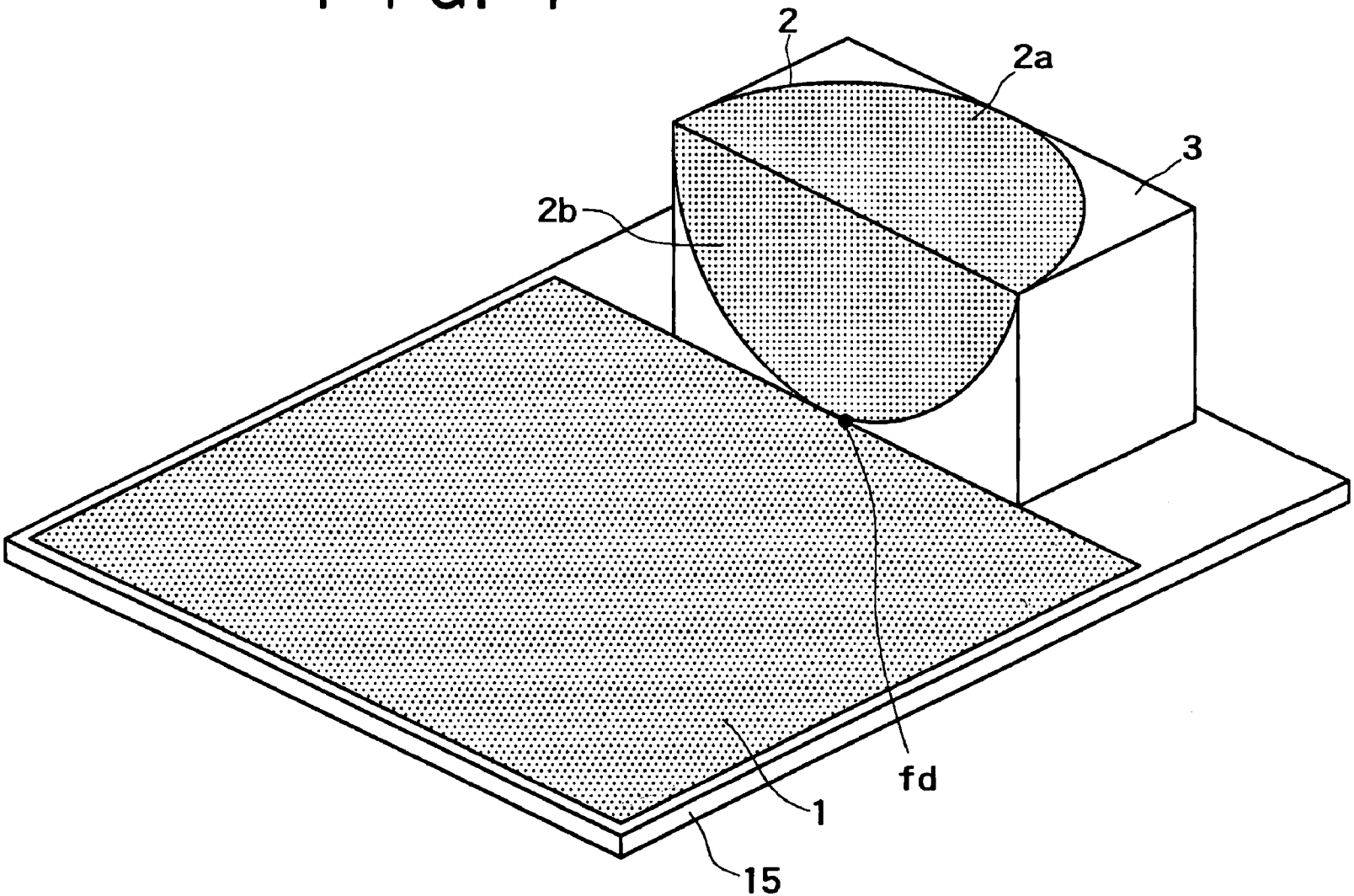
FIG. 7 is a perspective view of a broadband antenna apparatus according to a fifth embodiment of the present invention.

FIG. 7 shows a broadband antenna apparatus according to a fifth embodiment of the present invention. This apparatus is substantially identical in structure with the apparatus according to the first embodiment, except that the apparatus shown in FIG. 7 has a signal feeding point fd positioned at one end of a conducting ground plate 1 and includes a three-dimensional member 3 positioned outside the plate 1. For this reason, the same reference numerals are assigned to similar parts of the apparatuses according to the two embodiments.

Figure 8:
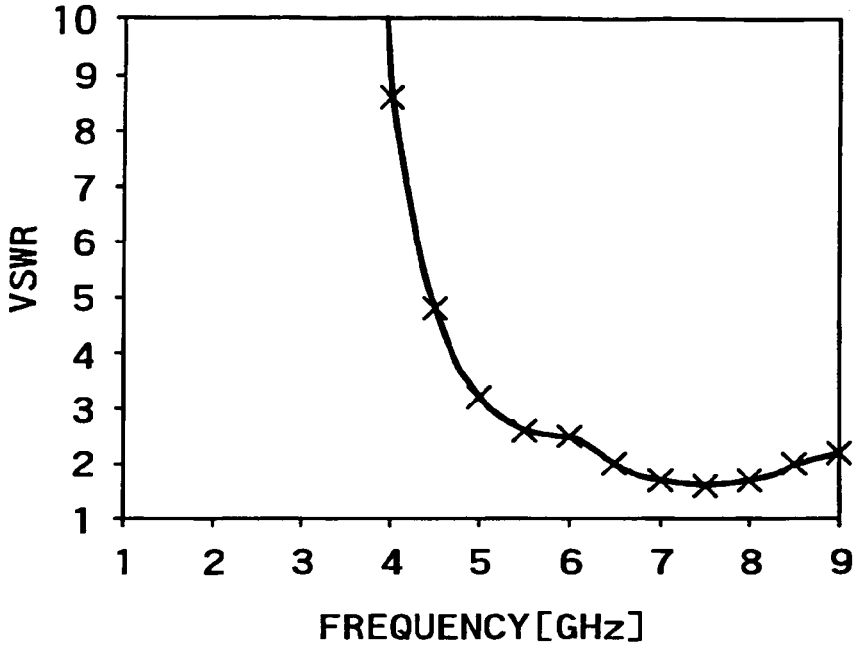
FIG. 8 is a chart of simulation results of the VSWR characteristic of the bent disk monopole antenna shown in FIG. 1.
Figure 9:
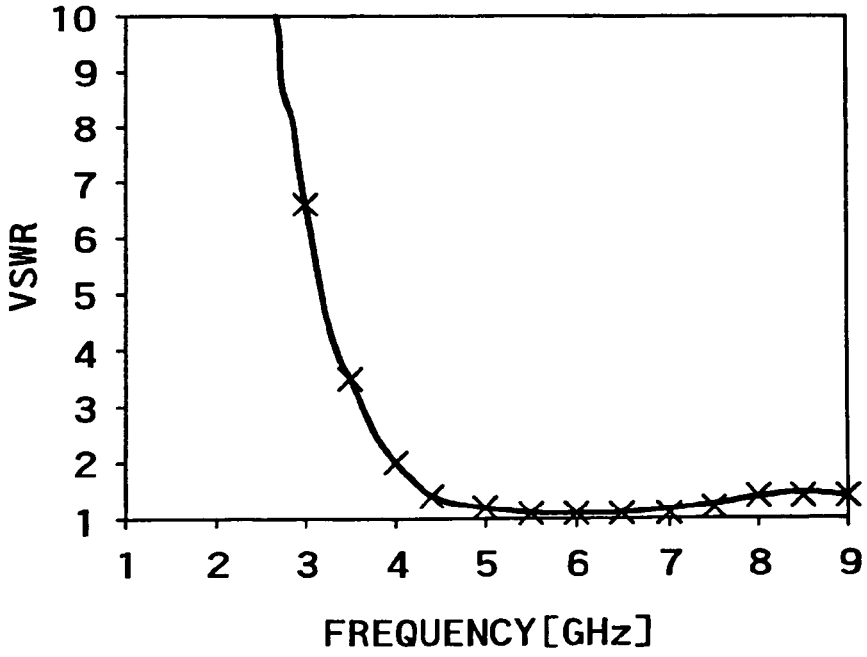
FIG. 9 is a chart of simulation results of the VSWR characteristic of the bent disk monopole antenna shown in FIG. 7.
Figure 10A:
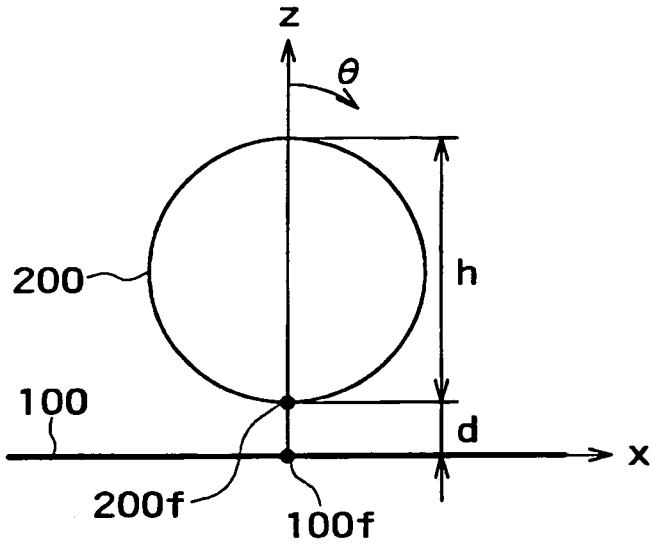
FIG. 10A PRIOR ART
FIG. 10A is a side view of a disk monopole antenna, which is an example of the conventional UWB antenna apparatus.
Figure 10B:
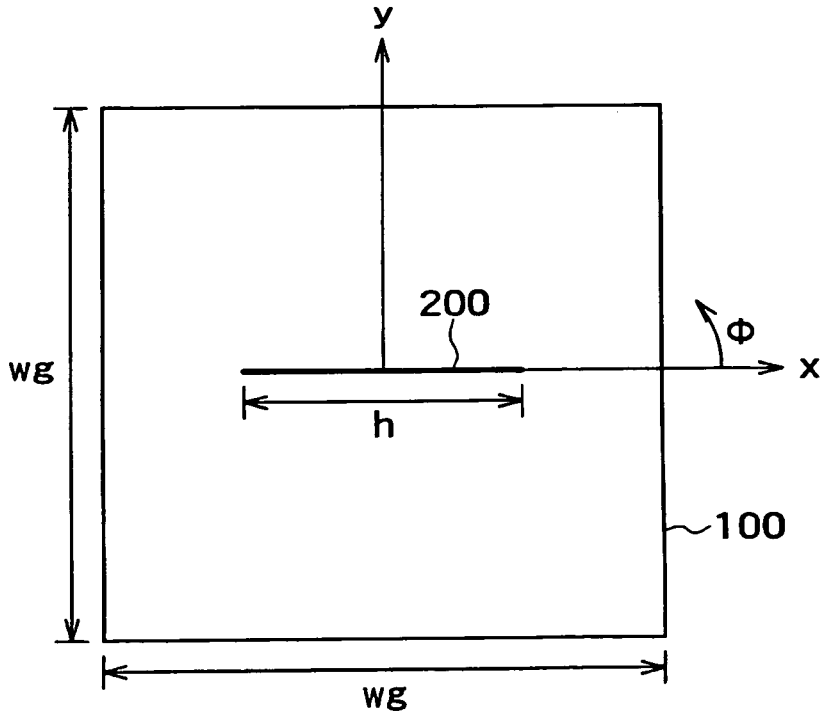
FIG. 10B PRIOR ART
FIG. 10B is a top plan of the antenna shown in FIG. 10A.

FIGS. 8 and 9 show the VSWR characteristics of the antennas according to the first and fifth embodiments respectively. It is possible to obtain wider-band characteristics by thus positioning the signal feeding point fd at one end of the conducting ground plate 1, and positioning the three-dimensional member 3 outside the plate 1.

In each of the broadband antenna apparatuses according to the first through fourth embodiments shown in FIGS. 2–6B, the signal feeding point fd is positioned on the conducting ground plate 1 or 11. In each of these apparatuses, the signal feeding point fd might be positioned at one end of the ground plate 1 or 11, and the three-dimensional member 3 or 13 might be positioned outside the plate 1 or 11, as shown in FIG. 7, with the member 3 or 13 and the radiating conductor 2 or 12 shaped as shown in FIGS. 2–6B and the resistance material/s 4 or 14 positioned as shown in FIGS. 2–6B.

In each of the broadband antenna apparatuses according to the first through fifth embodiments, the three-dimensional member 3 or 13 may have any dielectric constant and be a dielectric material, a magnetic material, or a foamable solid that has a relative dielectric constant of about 1 and a relative magnetic permeability of about 1.

It is preferable that the three-dimensional member 3 or 13 should have an electric conductivity between about 0.1/$m and 10.0/Ωm. The three-dimensional member having an electric conductivity within this range causes signals to leak moderately between the conducting ground plate and the radiating conductor. This causes a loss, which reduces reflected waves so that the broadband antenna apparatus can operate in a wider frequency band.

The three-dimensional member 3 or 13 is a rectangular parallelepiped or a cube, but might be a polyhedron, a sphere, or the like. The radiating conductor 2 or 12 might be provided on two or more sides of a polyhedron, or on a sphere. The part of the radiating conductor 2 or 12 that is opposite to the conducting ground plate 1 or 11 is parallel to it, but might be substantially parallel to it or inclined with respect to it.

The radiating conductor 2 or 12 takes the form of a circle or part of a circle, but might take the form of an ellipse, part of an ellipse, a rectangle, a combination of a semicircle or a sector and a rectangle, a star, or the like.

As described hereinbefore, the broadband antenna apparatus according to the present invention is smaller and lower in structure so as to be easy to incorporate into even small equipment. As also described, this apparatus can be produced easily and provided at low cost.

The foregoing invention has been described in terms of preferred embodiments. However, those skilled, in the art will recognize that many variations of such embodiments exist. Such variations are intended to be within the scope of the present invention and the appended claims.

What is claimed is:

1. A broadband antenna apparatus comprising:

a substrate having a conducting ground plate;

a three-dimensional polyhedron member disposed on the substrate; and a radiating conductor disposed on at least two adjacent sides of the three-dimensional polyhedron member and having a feedpoint positioned adjacent to, but electrically insulated from, the conducting ground plate, and said feedpoint configured to have electrical power transmitted thereto by a feed mechanism, the radiating conductor including a plurality of semicircular patterns formed on the each of said two adjacent sides of the three-dimensional polyhedron member; and resistive material interposed between, and connecting, the plurality of semicircular patterns.

* * * * *

UNITED STATES PATENT AND TRADEMARK OFFICE

CERTIFICATE OF CORRECTION

PATENT NO. : 7,030,817 B2
APPLICATION NO. : 11/079245
DATED : April 18, 2006
INVENTOR(S) : Hisato Asai et al.

It is certified that error appears in the above-identified patent and that said Letters Patent is hereby corrected as shown below:

Title Page, Under Notice: - insert --This patent is subject to a Terminal Disclaimer--.

Column 1, line 55, change “110B”, to--10B--.

Column, 8, line 34, change “0.1$m” to --0.1/Ωm--.

Signed and Sealed this

Thirteenth Day of February, 2007

JON W. DUDAS
*Director of the United States Patent and Trademark Office*